United States Patent [19]

Blomgren, Jr.

[11] Patent Number: 4,980,797

[45] Date of Patent: Dec. 25, 1990

[54] OVEN AND IMPROVED ENERGY TRANSFER APPARATUS

[75] Inventor: Oscar C. Blomgren, Jr., Lake Forest, Ill.

[73] Assignee: Inter-Probe, Inc, Gurnee, Ill.

[21] Appl. No.: 332,955

[22] Filed: Apr. 3, 1989

[51] Int. Cl.[5] ..... F28F 13/16; H01T 19/04

[52] U.S. Cl. ..... 361/233; 219/388; 219/399

[58] Field of Search ..... 361/233, 231; 55/126, 55/136, 152; 219/388, 399

[56] References Cited

U.S. PATENT DOCUMENTS

| | | | |
|---|---|---|---|
| 4,185,316 | 1/1980 | Fleck | 361/231 |
| 4,227,894 | 10/1980 | Proynoff | 361/231 |
| 4,377,839 | 3/1983 | Blomgren, Jr. et al. | 361/233 |

*Primary Examiner*—A. D. Pellinen
*Assistant Examiner*—Richard Elms
*Attorney, Agent, or Firm*—Lloyd L. Zickert

[57] ABSTRACT

An oven of modular construction to enhance cleaning and an improved energy transfer apparatus, wherein the oven includes a frame having a base on which is removably mounted a conveyor and a heating unit and a hood movably mounted relative to the base to coact with the conveyor by having an inlet and an outlet end, and a removable energy transfer apparatus mountable in the hood together with a heater. The improved energy transfer apparatus has stronger electrode or probe construction to avoid distortions and warping and better maintain the spacing relation with grid bars or wires together with being arranged and configured to minimize the height of the apparatus and to increase the effective energy transfer over the surface of the target to eliminate striping of a food product, thereby providing a more uniform application of the energy to the target. The probe construction also increases the width of energy transfer coverage not only to decrease the cost of the apparatus but also to minimize the operating costs.

16 Claims, 5 Drawing Sheets

OVEN AND IMPROVED ENERGY TRANSFER APPARATUS

DESCRIPTION

This invention relates in general to an improved electrostatic energy transfer apparatus and an oven utilizing the apparatus which is of modular construction to enhance cleaning, and more particularly to an improved electrostatic energy transfer apparatus capable of producing more uniform application of energy to the target and increasing the width of coverage by a substantial amount.

BACKGROUND OF THE INVENTION

Heretofore, it has been known to provide an electrostatic energy transfer apparatus as particularly disclosed in U.S. Pat. No. 4,377,839, owned by the assignee of this application, wherein the apparatus includes a frame supporting a plurality of probes in the form of a probe strip having a plurality of spaced apart points and grid wires symmetrically arranged to the points. The probe strips and points are vertically arranged and facing downwardly thereby focusing the electrostatic field vertically, and a source of high voltage low amperage direct current is directed across the probe strip and grid wires to produce the transfer of energy toward the target. This patent also discloses the mounting of the probe strips and the grid wires to the frame so as to permit independent expansion and contraction. Because the probe strips are vertically arranged, and it is necessary to space the grid wires from the points such as to preclude arcing between the grid wires and the points, the vertical height of the unit is dictated by these parameters. It is also necessary to appropriately space apart horizontally the probe strips in order to avoid interference with the action of one strip with another. Because the probe strips are vertically extending, the coverage for the strip relative to a target is somewhat narrow.

With respect to use of the heretofore known electrostatic energy transfer apparatus in an oven for cooking foods, it has been found that during a time when the foods are not moving beneath the apparatus, concentrated energy from the probe strips produces striping of the food product.

SUMMARY OF THE INVENTION

The present invention obviates the difficulties heretofore experienced in electrostatic energy transfer apparatuses in that the strength of the probe strip is substantially increased while reducing the height of the apparatus and significantly increasing the width of the electrostatic field produced by the apparatus. With the increased strength of the probe strip, the life of the unit is greatly enhanced. Increasing strength is obtained by forming the probe strip like an angle iron where two strips are effectively joined and extend about 90 degrees from each other and about 45 degrees from the horizontal. Probe points are spaced along the edges of the strips and thereby point in a direction about 45 degrees from the horizontal and thereby directing the electrostatic field of each strip about 45 degrees from the horizontal. Grid wires are provided for each set of points and spaced symmetrically from the points at a distance to prevent arcing between the grid wires and the points. Thus, the projected action of a probe strip is in two directions about 90 degrees apart and about 45 degrees from the horizontal.

Adjacent probe strips are spaced so that planes along which the points extend of adjacent probe strips will intersect at a point below the apparatus. Likewise, the electrostatic fields of adjacent strips will intersect prior to reaching the target. This arrangement reduces the overall height needed for the apparatus and increases the coverage at the target by about 50 percent.

Further, inasmuch as the coverage or application of energy to the target is now more uniform as the air flow sweeps over the surface of the target, striping of a food product that is not moving beneath the apparatus is substantially eliminated. The number of probe strips or electrodes needed by a single unit is decreased by the ability of a probe strip to provide increased coverage of the transfer of electrostatic energy. Thus, the number of electrodes needed for a unit is decreased and the amount of power needed for the unit is similarly decreased. This translates to a lower cost for the operating components needed for driving the apparatus as well as lower operating costs. The present invention reduces the conventional free convection cooking times by more than 50 percent.

By decreasing the height of the apparatus, the overall height of an oven in which the apparatus is mounted is likewise decreased, thereby, among other things, facilitating a stacked oven arrangement with multiple layers and/or multiple conveyers. This further decreases the space needed above the target for receiving the apparatus.

It is therefore an object of the present invention to provide a new and improved electrostatic energy transfer apparatus having a stronger electrode construction so as to enhance the life of the apparatus and a configuration that reduces the height of the apparatus to decrease the space needed above the target for the apparatus.

Another object of the invention is in the provision of an improved electrostatic energy transfer apparatus having an electrode construction which increases the coverage of the apparatus by a substantial amount and which also substantially eliminates striping of a food product that is not moving beneath the apparatus, thereby decreasing the cost of the apparatus and the energy needed to operate the apparatus and improving the product.

It is a further object of the present invention to provide an oven of modular construction which includes removable heating elements, a removable conveyer, and a removable electrostatic energy transfer apparatus, all of which facilitate the cleaning and maintenance of the oven.

Other objects, features and advantages of the invention will be apparent from the following detailed disclosure, taken in conjunction with the accompanying sheets of drawings, wherein like reference numerals refer to like parts.

DESCRIPTION OF THE INVENTION

The improved electrostatic energy transfer apparatus of the invention, while being illustrated as a component of an oven for cooking foods, may be used in other equipment where it is desired to accelerate the transfer of energy between an energy source and a target. For example, where heat energy is directed toward a target by a device radiating heat, the use of the energy transfer apparatus of the invention, when disposed between the energy source and the target, will not only greatly accelerate the transfer of the heat from the source to the target but also enhance the efficiency of the energy. The cost of the high-voltage, low-amperage direct current power to drive the apparatus of the invention is more than offset by the efficiency of heat transfer, particularly because the transfer of heat from the heat source of the target is greatly accelerated.

It is understood that the energy transfer apparatus of the invention, while enhancing the transfer of heat energy to a target, is likewise useful for transferring cold energy to a target. It may also be employed wherever there is a need to produce an electrostatic field. The electrostatic energy transfer apparatus of the present invention, while incorporating all of the advantages of the energy transfer apparatus in the above mentioned patent, further overcomes some of the problems encountered by the apparatus of the patent. Particularly, where the apparatus is used for the transfer of heat energy to a target in connection with cooking of food products, the present invention eliminates striping heretofore encountered by the apparatus of the patent when the food product is not moving beneath the apparatus. The further advantage of being able to reduce the height of the electrostatic energy transfer apparatus so that in oven installations the overall height of the unit can be reduced is important for conserving space needed for the oven.

Figure 4:
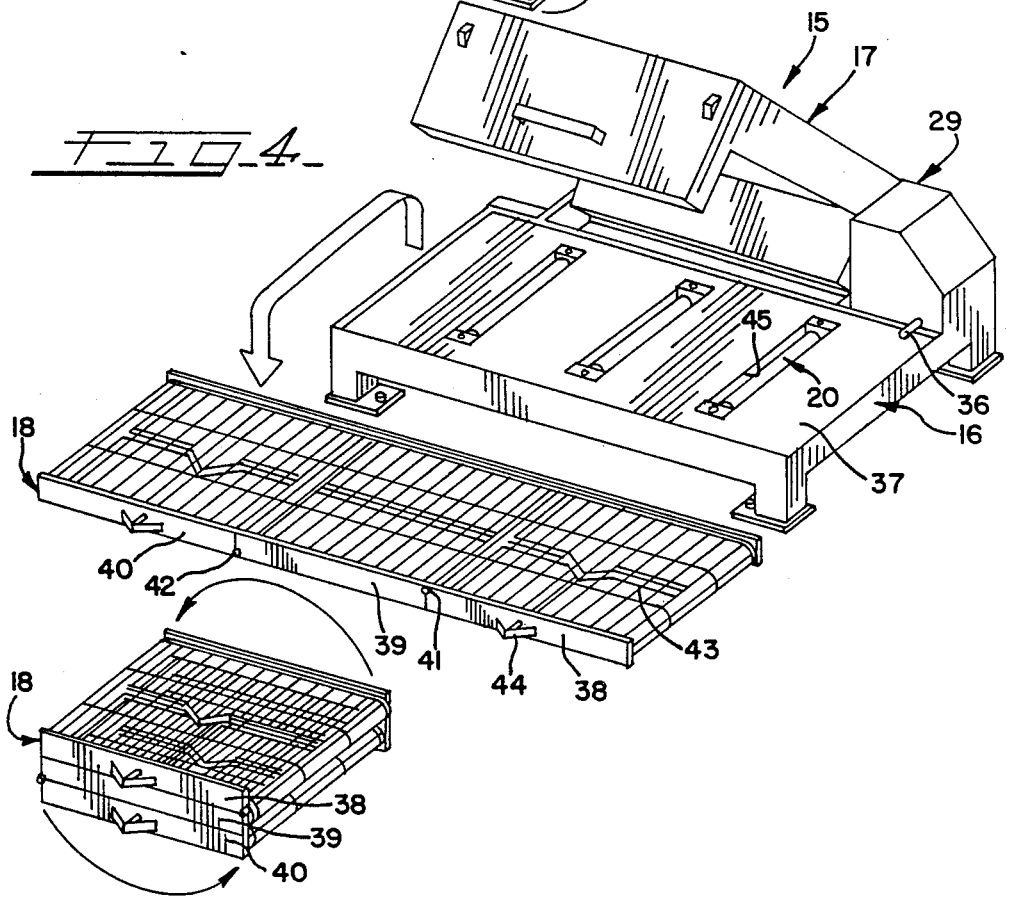
FIG. 4 is an exploded perspective view of the oven of FIG. 3 with the conveyer removed and also an illustration of how the conveyer can be folded into compact form for insertion into a dishwashing machine for cleaning purposes.
Figure 5:
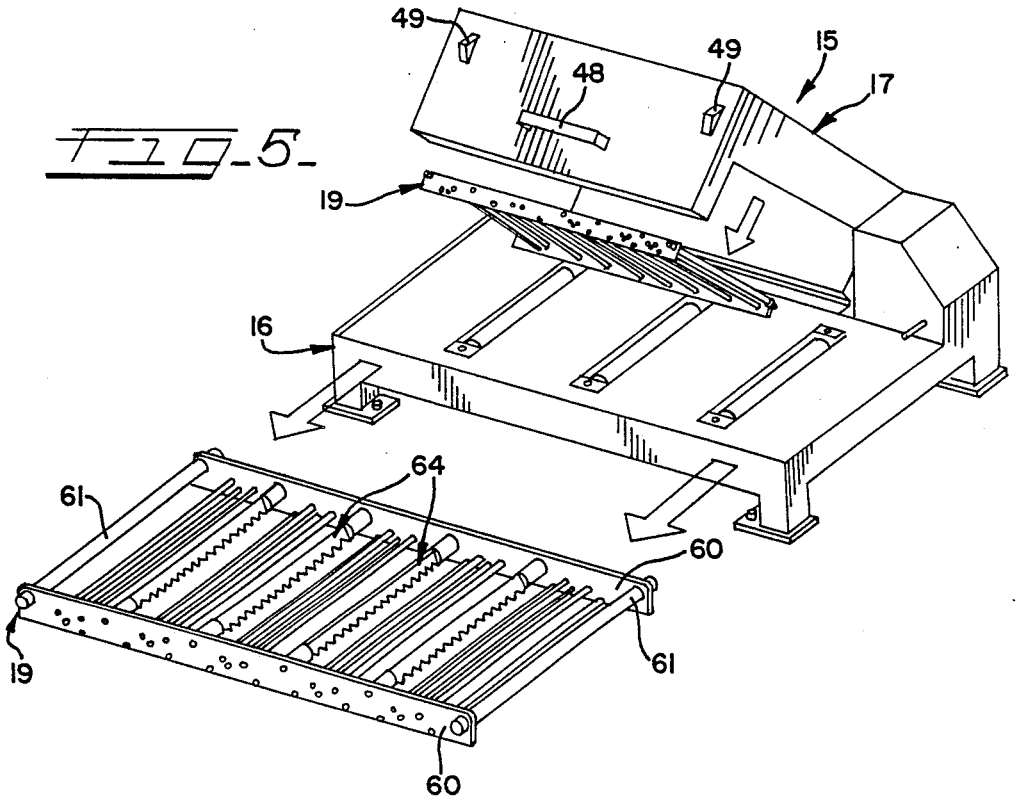
FIG. 5 is a perspective view of the oven having the conveyer removed and showing in exploded form how the electrostatic energy transfer apparatus is removed from the hood and then from the oven.

Referring now to the drawings, and particularly to FIGS. 1 to 6, the improved electrostatic energy transfer apparatus of the invention is illustrated for use in an oven of modular construction where the oven serves for cooking of foods. The oven, generally indicated by the numeral 15, includes a frame having a base or lower portion 16 and a hood or upper portion 17. Removably mounted on the base is a conveyer 18, as illustrated in FIG. 4, and removably mounted on the hood 17 is an electrostatic energy transfer apparatus 19, as shown in FIG. 5. Also removably mounted on the base in the embodiment of FIG. 4 are a plurality of electric heating element pods 20, and in the embodiment of FIG. 6 a gas burner module 21. Removability of the conveyer, electrostatic energy transfer apparatus, and the electric heating pods or the gas burner module facilitates the ability to effectively clean the oven after use and to effectively conduct periodic maintenance.

Figure 1:
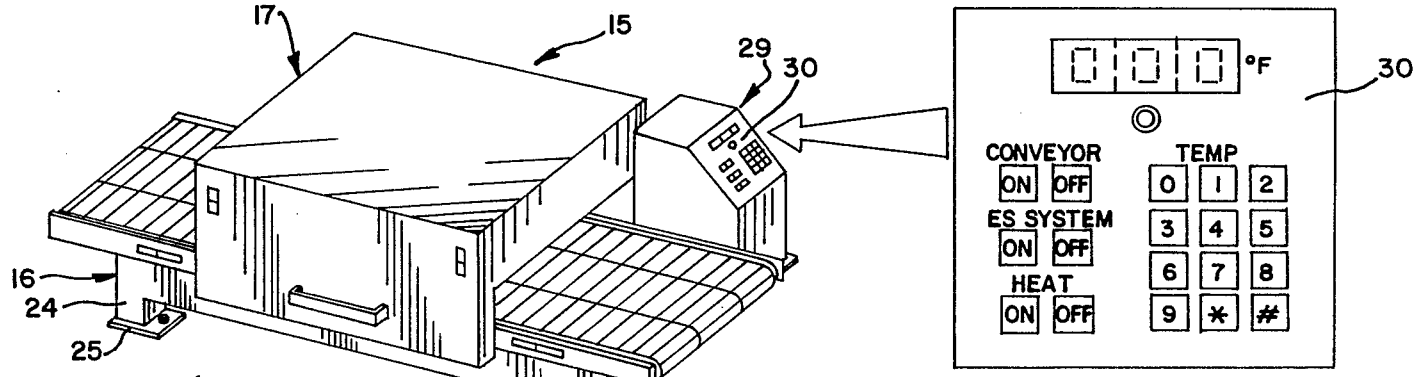
FIG. 1 is a perspective view of the oven of the present invention as assembled and ready for operation and which includes short legs so that it can be mounted on a countertop.
Figure 2:
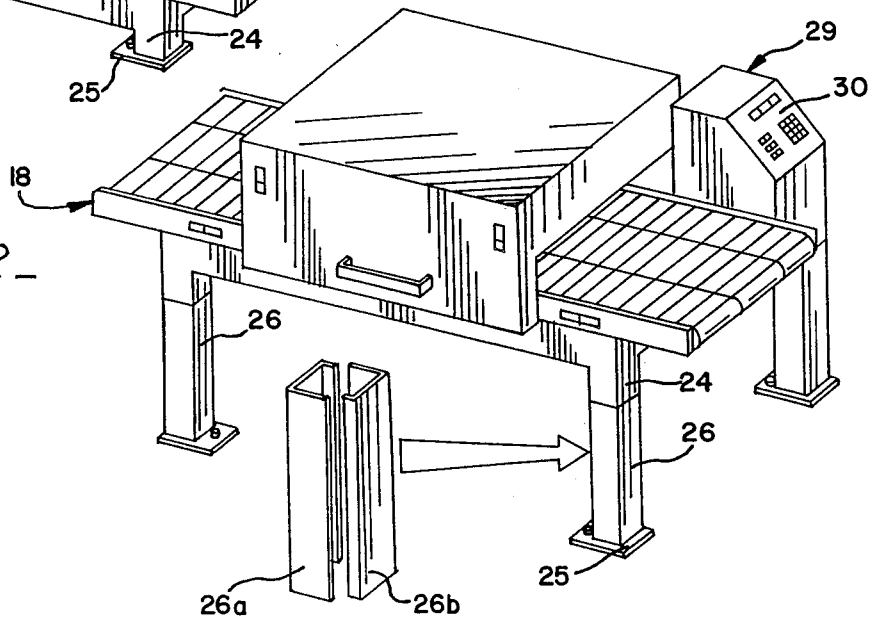
FIG. 2 is a perspective view of the oven of FIG. 1 but which illustrates an extension for the legs so that the oven can be mounted on the floor and place it at a comfortable working level.
Figure 3:
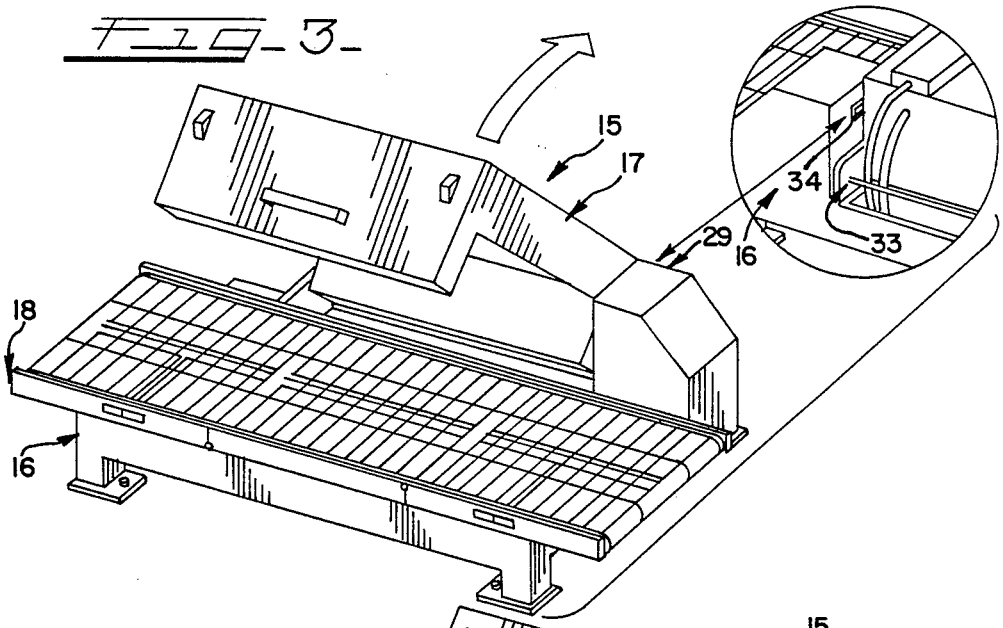
FIG. 3 is a perspective view of the oven of FIG. 1 with the hood in raised position to expose the conveyer and showing in the inset a limit switch actuable upon raising of the hood to cut all power to the oven for safe maintenance.

The base 16 in the embodiment of FIG. 1 includes short legs 24 suitably secured to pads 25 which in turn would be received on a counter surface. The pads could also be then secured to the counter surface. The embodiment of FIG. 1, being designed to rest on a counter surface, places the oven at an operating level for the comfort of an operator feeding product to the inlet end and removing it from the outlet end.

Where it would be desired to mount the oven on the floor, leg extensions 26 made up of channel members 26*a* and 26*b*, as seen in FIG. 2, may be used between the short legs 24 and the pads 25 to set the oven at an operating level desired by the user. The segments 26*a* and 26*b* may be secured together in any suitable fashion to form the leg extension which then is secured in any suitable fashion to the short leg and the pad.

As seen particularly in FIGS. 1 and 2, a control box 29 having a control panel 30 with switches and gauges is provided for monitoring and controlling the operation of the oven. Inasmuch as the controls do not form any part of the invention, there details are not disclosed, although it will be understood that the controls operate the conveyer, heating elements in the form of electric pods or gas burners in the base, the energy transfer apparatus, and any heating elements in the hood.

The hood 17 is mounted to the base 16 so that it can be moved to a position for servicing and/or removing the conveyer, the electrostatic energy transfer apparatus, and the heating elements. While the hood may be movably mounted in any suitable manner, it is shown to be hinged to the base by hinge means 33, as seen particularly in FIGS. 3 and 6, so that the hood 17 can swing up and away from the conveyer to expose the conveyer as well as to expose the inside of the hood for removal of the electrostatic energy transfer apparatus, as seen particularly in FIGS. 3, 4 and 5. Any suitable mechanism may be provided for maintaining the hood in the upper open position during servicing of the machine. As a safety feature, a limit switch 34 mounted on the base 16 will be actuated upon initiating the opening of the hood in order to cut all power to the oven during servicing.

The conveyer 18 is removable to facilitate cleaning of the oven and also to enable easy cleaning of the conveyer. As seen in FIG. 4, the conveyer 18 is shown in removed position from the base 16 of the oven, it being appreciated that the conveyer may rest on the upper surface 37 of the base when in proper position and also be suitably drivingly connected to a power source in the console or control box 29 by means of a power takeoff shaft 36. The belt of the conveyer is such that heat can easily pass through the conveyer to the food supported on the conveyer.

As seen in FIG. 4, the conveyer 18 is segmentally constructed of segments or sections 38, 39 and 40 that are hinged together so that the three segments may be folded into stacked position. As seen in FIG. 4, hinge 41 is provided between the center segment 39 and the outer segment 38, and hinge 42, provided between the center segment 39 and the other outer segment 40, so that when the segments are folded together they will be sized to enable them to be passed through a standard dishwasher. When the segments are arranged in end-to-end position and coplanar, as also shown in FIG. 4, as well as in FIG. 3, they are locked in place by locking members 43 which are actuated by handles 44 to facilitate the folding operation. Once the conveyer is removed from the base, the electric heating pods 20 may also be removed for purposes of cleaning the pods and the cavities in which the pods are received. Each electric heating pod is recessed within openings 45 formed on the upper surface of the base 16.

Figure 6:
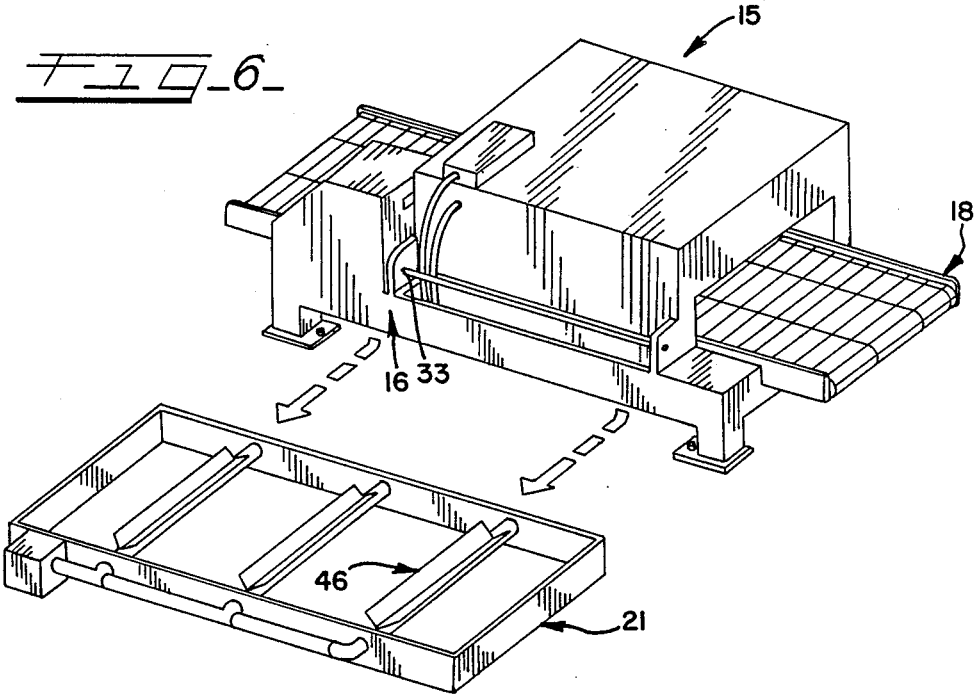
FIG. 6 is a rear perspective view of the oven of FIG. 1 and showing in exploded view the removal of the heating unit from the base of the oven and also illustrating the heating unit in the form of a gas burner module, while in the illustrations of FIGS. 4 and 5 the heating unit is shown in the form of electrical heater pods.
Figure 7:
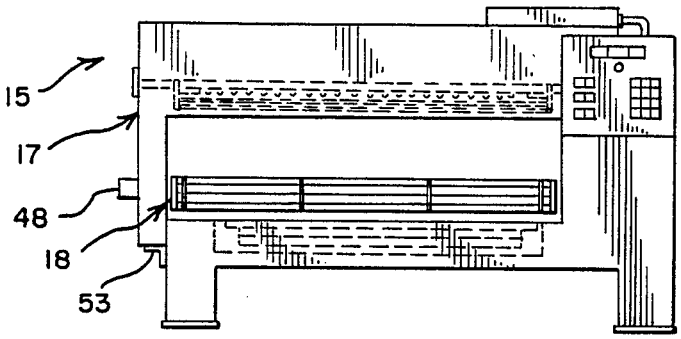
FIG. 7 is an end view of the oven of FIG. 1 and looking at the inlet end while showing in phantom the positions of the heating element and electrostatic energy transfer apparatus.

With respect to the embodiment of FIG. 6, where the heating element is in the form of the gas burner module 21, it will be appreciated that it will be removable from the base from the underside as illustrated. Thereafter, the burner module may be cleaned as well as the openings in the base in which the burners 46 of the module may extend.

The electrostatic energy transfer apparatus 19 is also easily removable from the hood 17 as illustrated in FIG. 5. It will be appreciated that suitable means will be provided for locking the apparatus in the hood when it is ready for use. Removal of the unit makes it easier for cleaning the unit and also for cleaning under the hood. It will be appreciated that the hood 17 is in its raised position when the energy transfer unit is removed or replaced. For purposes of facilitating the opening and closing of the hood, a handle 48 is provided on the front face. Additionally, locking elements 49 accessible from the front face of the hood serve to lock the hood in its down and operating position.

It will also be appreciated that when the hood is in its closed or down position, the lower front end may rest on a stop or flange 53 for correctly positioning the hood and the energy transfer apparatus in the hood relative to the upper moving surface of the conveyer 18.

The improved electrostatic energy transfer apparatus 19 of the invention is illustrated in FIG. 5 and more particularly in FIGS. 8 to 14. The apparatus includes opposed parallel side plates 60 interconnected at their ends by crossbars 61 to form a relatively rectangular frame for holding the electrodes or probes, the grid wires, heating elements, and other components. Extending between the side plates are one or more electrodes or probes 64, there being four illustrated in FIG. 5 and only two illustrated in FIGS. 11 and 13. It will be appreciated that any number of probes may be provided so that uniform transfer of energy can be accomplished by the unit. Each probe 64 includes a probe strip 65 and end insulators 66. Thus, the probe strips are electrically insulated from the frame defined by the side plates 60 and the end cross rods 61.

Figures 11, 12, 13, 14:
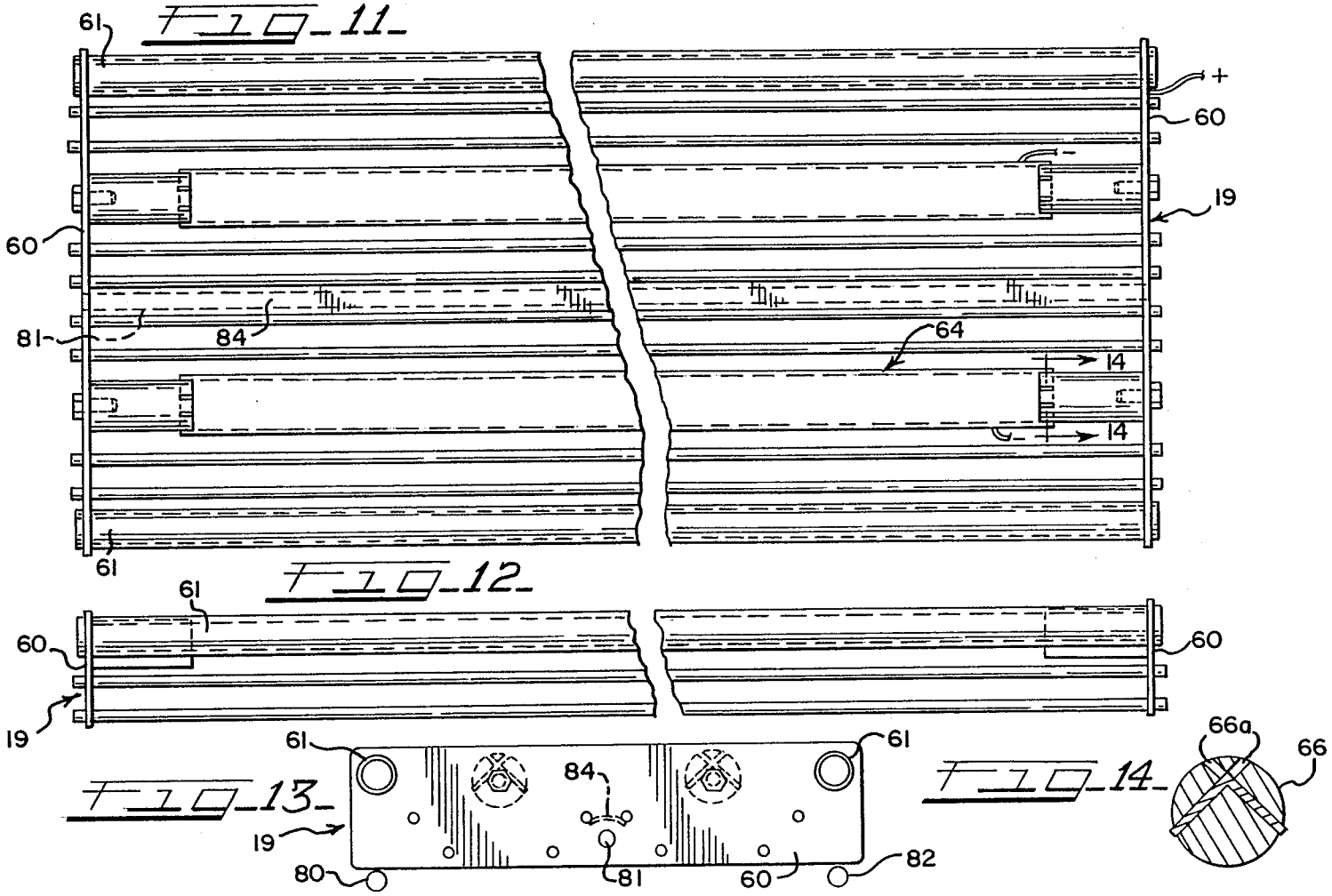
FIG. 11 is a broken top plan view of the electrostatic energy transfer apparatus of the present invention.
FIG. 12 is a broken side elevational view of the electrostatic energy transfer apparatus shown in FIG. 11.
FIG. 13 is an end elevational view of the electrostatic energy transfer apparatus shown in FIG. 11.
FIG. 14 is a transverse sectional view taken through the mounting for a probe strip and substantially along line 14—14 of FIG. 11.

Each probe strip 65 is inverted V-shape in cross section and includes strips **65*a* and 65*b* extending about 90 degrees from each other and about 45 degrees from the horizontal and from the vertical. So, the probe strip 65 is in the form of an angle iron with legs 65*a* and 65*b* that collectively form a rigid member much stronger than a single probe strip situated vertically as in the aforementioned patent. Accordingly, the probe strip of the invention can withstand greater forces that would tend to warp or distort the strip. Further, by inclining each strip leg, the height of the probe strip is reduced. The free edge of each strip leg has a sawtooth edge, thereby defining a plurality of longitudinally spaced apart probe or corona discharge points 65*c*. However, it may be appreciated that the probe points may be further spaced apart than shown, such as in a form illustrated in the aforementioned patent. As seen most clearly in FIG. 14, each of the electrical insulators 66, which may be formed of any suitable insulating material such as dielectric ceramic or high-temperature plastic, will be provided with slots to receive the ends of the probe strip 65. The slots, designated 66*a* in FIG. 14, are deep enough to allow expansion of the probe strip, thus preventing thermal distortion. The insulators are otherwise suitably connected to the side plates 60**. Thus, the probe strips are electrically insulated from the side plates.

Also supported in the frame of the unit and extending between the opposed side plates 60 are a plurality of grid wires or rods. The grid wires are arranged in pairs, there being a pair for each of the probe strip legs or row of points.

Figure 8:
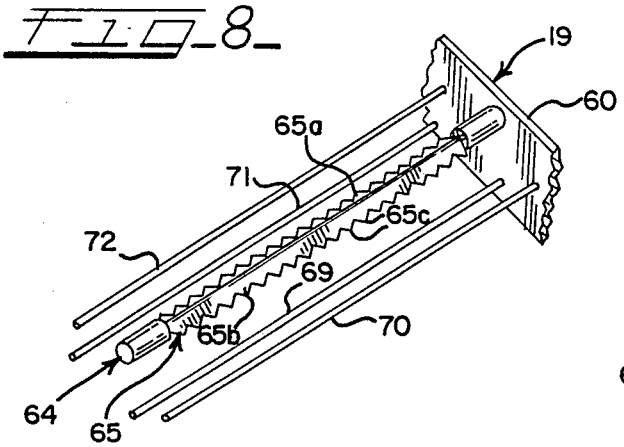
FIG. 8 is an enlarged fragmentary perspective view of the electrostatic energy transfer apparatus to illustrate one electrode having two strips of points, and associated grid wires.
Figure 10:
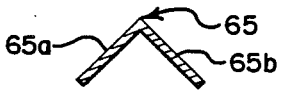
FIG. 10 is a transverse sectional view taken through the probe strip substantially along line 10—10 of FIG. 9.
Figure 9:
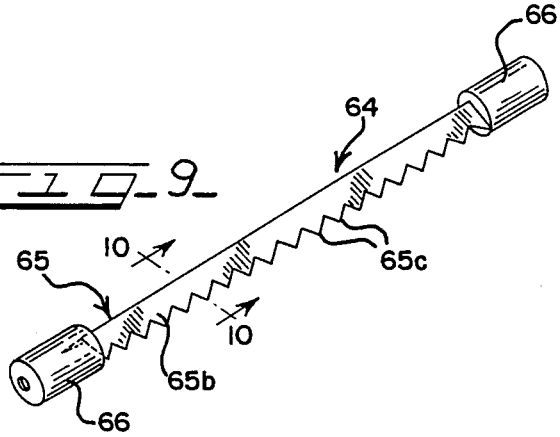
FIG. 9 is a still further enlarged perspective view of an electrode or probe removed from the frame.

Referring to FIG. 8, the grid wires 69 and 70 are arranged symmetrically to the points **65*c* of the probe strip leg 65*b*, while grid wires 71 and 72 are arranged symmetrically to the points 65*c* of the probe strip leg 65*a*. Further, the grid wire pairs for each probe strip leg are spaced apart equally from each other and from the probe strip points and at a distance to prevent arcing between the points and the grid wires when a voltage is placed across the probe strip and grid wires. Mounting of the grid wires in the side plates 60** is preferably accomplished by providing openings in the side plates through which the wires matingly extend, and so that the fit between the wires and the side plates is such as to allow independent expansion of the grid wires with respect to the plates. The wires may be loosely retained on the plates by clips or the like.

Where it may be desired to have heating elements associated with the energy transfer apparatus 19, they may be provided in the form of calrod units 80, 81 and 82, as seen in FIG. 13, so that they are arranged to provide heat energy to the electrostatic energy produced by the probe strips so as to transfer the heat energy of the calrod units to the target. With respect to the centrally located calrod unit 81 which is mounted outside the ion stream and below the grid plane, a reflector 84 may extend between the plates for assisting in reflecting downwardly toward the target heat radiated from the calrod unit. Calrods 80 and 82 are shown mounted below the frame but in the ion stream, although they could be mounted on the frame and in the stream. It should be appreciated the location of the calrods may depend on the application for the unit, and that they may even be in the form of an array mounted below the unit to satisfy certain electrical requirements. Other heating means may be used in place of calrods.

A high-voltage, low-amperage direct current source is connected between the probe strips 64 and the grid wires in any suitable manner. With respect to mounting the energy transfer unit in the hood of the oven, it may be appreciated that they would engage conductors in order to connect one side of the power source to the probe strips and the other side to the grid wires and frame. For example, suitable conductive spring members may be engaged by the probe strips and the frame so that the high-voltage, low-amperage direct current source would be connected across the probe strips and grid wires. It will be appreciated that a suitable power supply will be provided to properly drive the energy transfer unit and produce the air flow/ion stream. A typical power supply or source would produce between 20,000 and 30,000 volts and not more than about seven milliamperes. The effect desired of the energy transfer unit can be regulated by the voltage source, it being appreciated that the energy transfer action is proportional to the level of voltage and current applied. With respect to operation of the unit, the disclosure of the aforementioned patent is incorporated as to the type of power source and as to the function of the unit. As disclosed in the aforesaid patent, driving the energy transfer unit with a suitable high-voltage, low-amperage direct current source will generate a highly charged field between the apparatus and the target.

Preferably, the grid wires are connected to the positive side of the power source, and the probe strips are connected to the negative side of the power source. However, it should be appreciated that the unit will operate when the connections are reversed.

As above mentioned, the fit between the probe strips and the insulators is such as to allow independent thermal expansion and contraction of the strips relative to the frame. Similarly, the grid wires are carried by the frame such as to allow independent thermal expansion and contraction apart from the frame of the unit.

Although the points 65*c* of the probe strips are triangular in form, as illustrated, and which may be the most efficient structure, it should be appreciated that they may take any other desired form. Further, the number of points along a probe strip may vary as long as they are preferably equally spaced apart so that uniform operation of the apparatus will be produced. While only two probe strips or bars are disclosed in the unit illustrated, it will be appreciated that any number may be utilized in order to provide the desired function and a uniform field toward the target. Inasmuch as the probe strip legs are angularly disposed to the horizontal, the direction of air movement generated will also be angularly related to the horizontal and for given parameters the effective width of the field generated by the unit will be greater than the width of the unit. Further, inasmuch as the directional mounting of the probe strip legs is angularly related to the horizontal disposition of the unit, it will be understood that a plane extended from the probe points of adjacent probe strips will intersect at a point below the unit, and it has been found that the air flow beyond the intersection is at a higher level than the air flow or ion stream coming directly off the points. This result improves the operation of the unit to provide greater efficiency. Further, it will be appreciated that the air stream from one line of points mixing with an air stream from an adjacent line of points will fill in the area between the adjacent probes to provide a more uniform electrostatic field and a more uniform transfer of energy to the target to avoid striping of the target when the conveyer is not moving.

The grid wires or rods are illustrated in pairs with respect to each of the probe strip legs, and it should be understood that it is necessary to have at least two grid wires in association with each probe strip leg. However, additional grid wires may be provided, if desired. As in the aforementioned patent, the geometric relation between the grid wires and the probe points is critical. The spacing between each grid wire and the points associated therewith must be identical along the entire length of the grid wires and series of points. The points must be positioned centrally between a pair of grid wires, and therefore it should be appreciated that it is important to allow independent thermal expansion and contraction of the grid wires and the probe strips in order to maintain proper spacial relation therebetween.

Depending on the atmosphere within which the apparatus is operating, the spatial relationship between the grid wires and probe points will vary for a given high voltage source. For example, the spatial relationship for refrigerated and/or low humidity and/or electrically stable atmospheres, one spatial relationship could be used. A greater spatial relationship would be needed for ambient atmospheres with average or normal humidity and conductivity conditions. A still greater spatial relationship would be needed for heated and/or high humidity and/or electrically unstable atmospheres. Thus, the apparatus may be constructed with an adjustment feature to vary the spatial relationship, such as providing plural pairs of holes for receiving the grid wires. Alternatively, the voltage may be varied and lowered appropriately when greater spatial relationships are needed.

The preferred materials for the energy transfer unit include electrically conductive metal for the frame, probe strips, and grid wires and electrically insulating material for the probe strip supports or end insulators. Alternatively, the probe strips, their supports and the grid wires could be made of electrically conductive material, while the frames supporting these elements could be made of electrically insulating material so that the probe strips are electrically insulated from the grid wires. Bus bars in the hood would be needed to interconnect the grid wires for connection to one side of the power source, and bus bars would be needed for interconnecting the probe strips for connection to the other side of the power source.

In view of the foregoing, it will be appreciated that an improved oven for cooking foods having modular construction to facilitate cleaning as well as ease of maintenance and replacement of parts is a feature of the invention. Another important feature of the invention is the improved electrostatic energy transfer apparatus which improves the efficiency of energy transfer while also decreasing the cost of operation.

It will be understood that modifications and variations may be effected without departing from the scope of the novel concepts of the present invention, but it is understood that this application is to be limited only by the scope of the appended claims.

The invention is hereby claimed as follows:

1. Apparatus for effecting electrostatic transfer of energy to a target comprising, a frame adapted to be spaced from the target, said frame having opposed supporting members, at least one probe carried by and insulated from said supporting members, said probe including an elongated strip of electrically conductive material having an inverted substantially V-shaped cross section defining a pair of probe strips, the free edges of said strips being serrated to define longitudinally aligned and spaced apart probe/corona points, at least two spaced apart grid wires of electrically conductive material arranged in equal symmetrically spaced relation to the probe points of each probe strip and carried by said supporting members, and a source of high-voltage low-amperage direct current connected across the probe and wires.

2. The apparatus of claim 1, wherein a plurality of probes are carried by and insulated from said supporting members, said probes being transversely and equally spaced apart such that planes extending from the probe strips will cross each other at intersections spaced below the frame.

3. The apparatus of claim 1, wherein the grid wires extend parallel to each other and to the longitudinal row of probe points.

4. The apparatus of claim 1, wherein the probe strips are connected to the negative side of the source, and the grid wires are connected to the positive side of the source.

5. The apparatus of claim 1, wherein the grid wires are connected to the positive side of the source.

6. The apparatus of claim 1, wherein the grid wires are connected to the negative side of the source.

7. The apparatus of claim 1, wherein the frame is horizontally disposed and each probe strip extends about 45 degrees from the horizontal.

8. The apparatus of claim 7, wherein each probe strip extends about 90 degrees from each other.

9. Apparatus for effecting electrostatic transfer of energy to a target or targets comprising, a horizontally extending frame of rigid material adapted to be in spaced relation to the target, a probe of rigid material mounted on the frame and including an elongated strip of electrically conductive material of inverted V-shape cross section defining a pair of probe strips extending about 90 degrees from each other and about 45 degrees from the horizontal, the free edges of said strips being serrated to define longitudinally aligned and spaced apart corona discharge points, said probe being supported by the frame for independent expansion and contraction from the frame, at least two grid wires of electrically conductive material symmetrical to each probe strip and supported by said frame, said grid wires being supported by the frame for independent expansion and contraction from each other and the frame, means electrically insulating said probe from said grid wires, and a source of high-voltage low-amperage direct current connected across said probe and grid wires.

10. The apparatus of claim 9, wherein the probe strips are connected to the negative side of the source, and the grid wires are connected to the positive side of the source.

11. The apparatus of claim 9, wherein a plurality of probes are carried by and insulated from said supporting members, said probes being transversely and equally spaced apart such that planes extending from the probe strips and the air flows produced by the strips will cross each other at intersections spaced below the frame.

12. The apparatus of claim 9, wherein heating elements are carried by said supporting members.

13. The apparatus of claim 11, wherein the spacing between said probes is such that the intersecting air flows of adjacent probe strips results in a greater air flow than that of one strip.

14. An oven of modular construction to enhance cleaning comprising, a plurality of removable working units, a frame receiving the working units and including a base defining a lower portion and a hood defining an upper portion, said hood being movable relative to the base to facilitate removal of certain working units, a conveyer removably mounted on said base, at least one heater removably mounted on the base and underlying the conveyer, said hood having an opening at each end aligned with the conveyer to define an inlet and an outlet and said conveyer extending ahead of the inlet and beyond the outlet, and a removable electrostatic transfer and heating apparatus for effecting electrostatic transfer of energy to a target received by said hood, said electrostatic transfer and heating apparatus including a frame having opposed supporting members, at least one probe carried by and insulated from said supporting members, said probe including an elongated strip of electrically conductive material having an inverted substantially V-shaped cross section defining a pair of probe strips extending about 90 degrees from each other, the free edges of said strips being serrated to define longitudinally aligned and spaced apart probe points, at least two spaced apart grid wires of electrically conductive material arranged in equal symmetrically spaced relation to the probe points of each probe strip and carried by said supporting members, and a source of high-voltage low-amperage direct current connected across the probe and wires.

15. The oven of claim 14, wherein said electrostatic transfer apparatus includes a plurality of probes.

16. The oven of claim 15, wherein said probes are spaced apart such that planes extending from adjacent probe strips will cross each other at intersections spaced below the frame.

* * * * *